US008902246B2

(12) United States Patent
Marcu et al.

(10) Patent No.: US 8,902,246 B2
(45) Date of Patent: Dec. 2, 2014

(54) COLOR CORRECTION FOR WIDE GAMUT SYSTEMS

(75) Inventors: Gabriel G. Marcu, San Jose, CA (US); Steve Swen, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 1015 days.

(21) Appl. No.: 12/976,992

(22) Filed: Dec. 22, 2010

(65) Prior Publication Data

US 2012/0162239 A1 Jun. 28, 2012

(51) Int. Cl.
*G09G 5/02* (2006.01)
*G09G 5/06* (2006.01)

(52) U.S. Cl.
CPC ..... *G09G 5/06* (2013.01); *G09G 2340/06* (2013.01)
USPC ..... 345/590

(58) Field of Classification Search
USPC ..... 345/590
See application file for complete search history.

(56) References Cited

U.S. PATENT DOCUMENTS 6,388,674 B1 * 5/2002 Ito et al. ..... 345/590
6,704,442 B2 3/2004 Haikin et al.
7,609,413 B1 10/2009 Marcu et al.
2002/0060799 A1 * 5/2002 Fukasawa ..... 358/1.9
2009/0303261 A1 * 12/2009 Fard ..... 345/690
2010/0215258 A1 8/2010 Mestha et al.

OTHER PUBLICATIONS

"Color Management with Mac OS X Tiger", Technology Tour, Dec. 2005, 28 pages.

* cited by examiner

*Primary Examiner* — Aaron M Richer
(74) *Attorney, Agent, or Firm* — Blakely, Sokoloff, Taylor & Zafman LLP

(57) ABSTRACT

At least certain embodiments of the disclosures relate to methods for performing color correction on systems having at least application that is not color managed. In one embodiment, a method to perform color correction on a system includes determining a threshold gamut. Then, the system determines whether a real gamut exceeds the threshold gamut. The system color corrects input color if the real gamut exceeds the threshold gamut. Color correcting may include adjusting input color in the system. In another embodiment, a system includes memory to store color data for at least one non-color managed application and to store color data for at least one color managed application. The system includes a display device to display the color data. The system includes one or more graphics processing unit that are configured to execute instructions to color correct input color when a real gamut value exceeds a threshold gamut value.

23 Claims, 12 Drawing Sheets

COLOR CORRECTION FOR WIDE GAMUT SYSTEMS

FIELD OF THE DISCLOSURE

The invention relates to color correction, and more particularly to color correction for wide gamut systems.

BACKGROUND OF THE DISCLOSURE

Some display devices have wide color gamuts. One of the problems associated with wide gamut displays is that the color matching in a typical color management workflow produces requires time and processing resources when a match is performed between small gamut source data and a destination device, which typically has a large gamut. Also, the quality of an image is reduced when a gamut stretching is performed to match the small gamut of the source to a larger gamut of a destination device in order to process the image on the destination device. Even if the mapping is from one display device to another display device, stretching the smaller gamut into a larger gamut may impose serious problems.

In most displays, it is desirable to have a wider gamut color space. However, input data (e.g., RGB values) can result in over-saturated colors when displayed on a wide gamut display. Color management can correct the over-saturation, but the time required for the color management may not be sufficient for certain applications such as web browsing applications.

SUMMARY OF THE DISCLOSURE

At least certain embodiments of the disclosures relate to methods for performing color correction on systems having one or more non-color managed applications and one or more color managed applications. In one embodiment, a method to perform color correction on a system includes determining a threshold gamut value. Then, the system determines whether a real gamut value of the system exceeds the threshold gamut value. The system color corrects input color if the real gamut value exceeds the threshold gamut value. Color correcting may include adjusting the input color in the system.

In one example according to this embodiment, whether the real gamut value exceeds the threshold gamut value is determined by comparing a size of a real gamut with a size of the threshold gamut in a chromaticity diagram. The color correcting further includes determining a virtual gamut. The virtual gamut of the device is, in one embodiment, defined based on the real gamut, the threshold gamut, and a limit gamut in a chromaticity diagram. Data from a non-color managed application may be drawn to a windows backing store with no color matching operation and data from a color managed application may be color matched from a source profile to a destination profile of the windows backing store.

Embodiments of the present invention include methods for generating virtual gamuts for performing color correction on a data processing system, machine readable media which contain data specifying such virtual gamuts, apparatuses which perform these methods, including data processing systems which perform these methods and computer readable tangible and non-transitory storage media which when executed on data processing systems cause the systems to perform these methods.

Other features of the present invention will be apparent from the accompanying drawings and from the detailed description which follow.

BRIEF DESCRIPTION OF THE DRAWINGS

The present invention is illustrated by way of example and not limitation in the figures of the accompanying drawings in which like references indicate similar elements.

DETAILED DESCRIPTION

At least certain embodiments of the disclosures relate to methods for performing color correction on systems having at least one non-color managed application and at least one color managed application. In one embodiment, a method to perform color correction on a system includes determining a threshold gamut value. Then, the system determines whether a real gamut value exceeds the threshold gamut value. The system color corrects input color if the real gamut value exceeds the threshold gamut value. Color correcting may include adjusting the input color in the system by determining a virtual gamut. The virtual gamut may be used for color correcting the input color for avoiding over-saturation of the color data displayed on the system.

Figure 1:
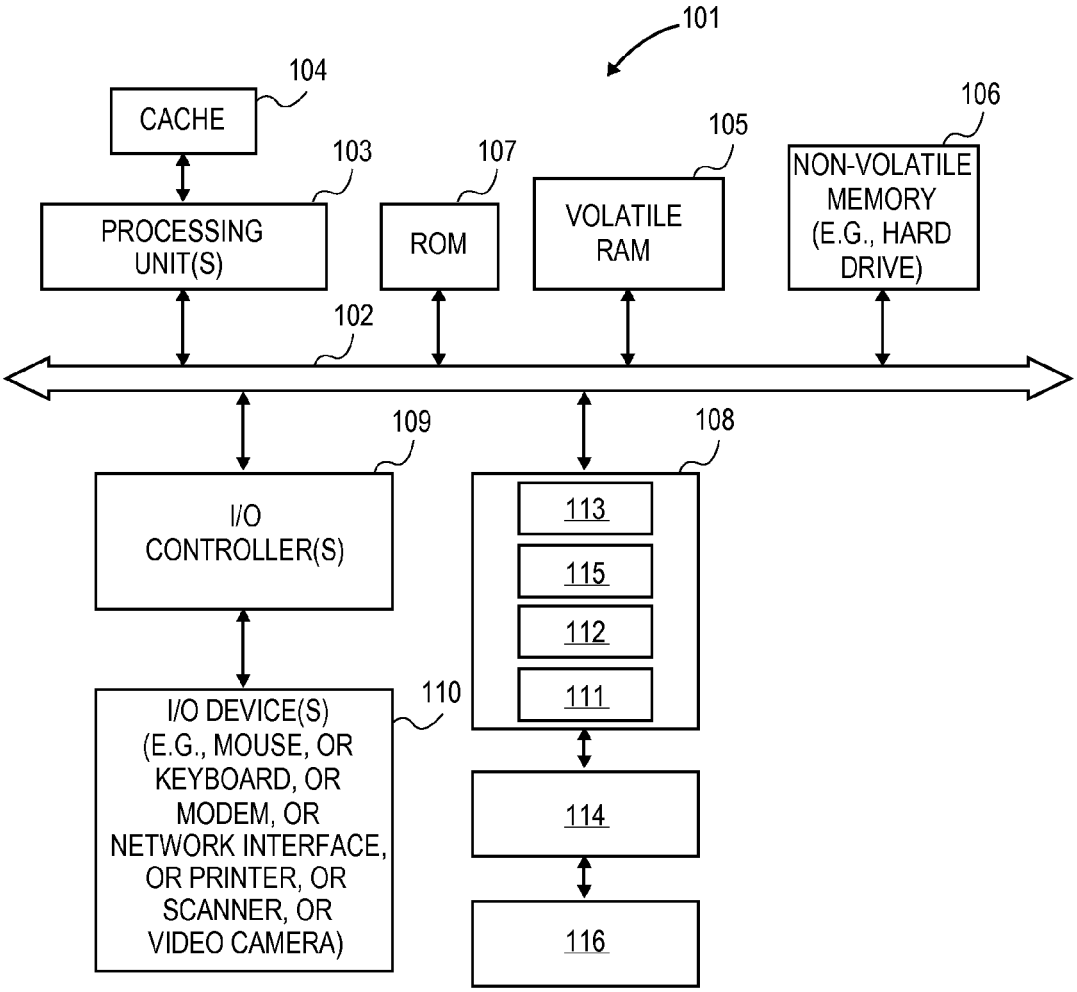
FIG. 1 shows a block diagram example of a data processing system in one embodiment of the present invention.

FIG. 1 shows an example of a data processing system with a wide gamut display in one embodiment of the present invention. Note that while FIG. 1 illustrates various components of a computer system, it is not intended to represent any particular architecture or manner of interconnecting the components as such details are not germane to the present disclosure. It will also be appreciated that personal digital assistants (PDAs), handheld computers (e.g., an iPad), cellular telephones (e.g., an iPhone), media players (e.g., an iPod), devices which combine aspects or functions of these devices, an embedded processing device within another device, network computers and other data processing systems which have fewer components or perhaps more components may also be used to implement one or more embodiments of the present disclosure. The computer system of FIG. 1 may, for example, be an Apple Macintosh computer.

Figure 2:
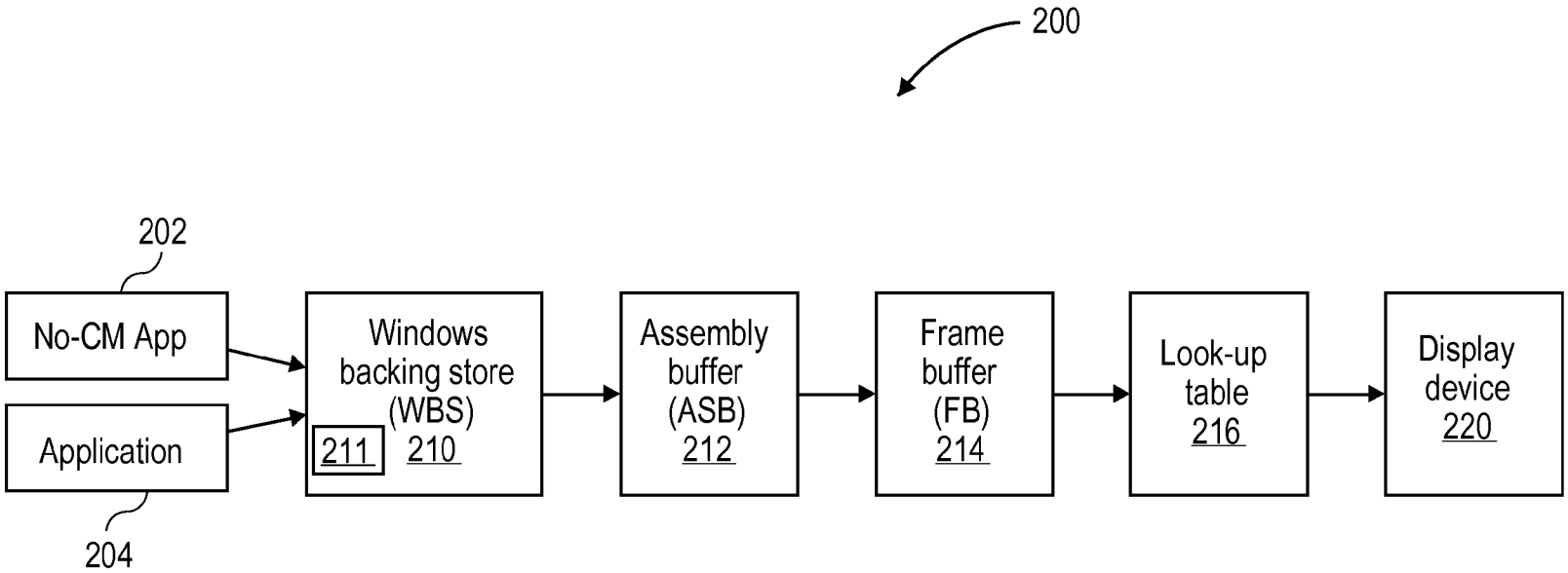
FIG. 2 illustrates a graphics architecture in one embodiment of the present invention.

As shown in FIG. 1, the computer system 101, which is a form of a data processing system, includes a bus 102 which is coupled to one or more processing units 103 and a ROM 107 and volatile RAM 105 and a non-volatile memory 106. The one or more processing units 103 are coupled to cache memory 104 as shown in the example of FIG. 2. The bus 102 interconnects these various components together and also interconnects these components 103, 107, 105, and 106 to display controller 108. The display controller 108 may include one or more graphics processing units 113, an assembly buffer 112 and a frame buffer 111. These buffers may be assigned one or more color profiles for the display 116. Windows backing store 115 may be located in the controller 108 or any of the memory components and may be assigned one or more color profiles (e.g., virtual profile) for color correction. Look up table 114 provides color correction information (e.g., gamma correction) for the display 116 and may external or internal with respect to the display controller 108. The look-up table may be located in a graphics card. The LUT is assigned to a display and the LUT converts color data from a target transfer function (e.g., gamma=2.2) to a native transfer function for the display.

The bus 102 also interconnects to peripheral devices such as input/output (I/O) devices 110 which may be mice, keyboards, modems, network interfaces, printers, scanners, video cameras and other devices which are well known in the art.

At least one embodiment of the present disclosure seeks to describe a data processing system 101 that includes one or more processing units 103 coupled to a bus 102. The data processing system 101 further includes a display device 116 coupled to the bus 102. One of the memory components (e.g, 104, 107, 105, 106, 108) stores color data and one or more color profiles. Each color profile specifies one gamut for the system 101. The processing units 103 and graphics processing units 113 are configured to execute instructions to color correct unmanaged color data. The graphics processing units 113 execute instructions to determine a threshold gamut value based on at least one of the color profiles (e.g., predetermined profile) or based on a visual preference of the user. For example, the predetermined profile may be based on the sRGB color space. Alternatively, the user may desire that the threshold gamut value is larger than a gamut of the sRGB color space within a certain percentage. The graphics processing units 113 also execute instructions to determine whether a real gamut value data exceeds the threshold gamut value and to color correct input color if the real gamut value exceeds the threshold gamut value. Color correcting can include adjusting the input color in the system, which can include one or more applications that are not color managed.

The graphics processing units 113 may determine whether the real gamut value exceeds the threshold gamut value by comparing a size of a real gamut of the system with a size of the threshold gamut in a chromaticity diagram. The color correcting may also include determining a limit gamut based on a National Television System Committee (NTSC) color space or an Adobe RGB color space. The color correcting may also include determining a virtual gamut that has a size that is greater than the size of the threshold gamut and less than the size of the limit gamut. The color correcting may further include generating a virtual profile of the system to specify the virtual gamut and replacing the real gamut with the virtual gamut of the system as will be explained in more detail in conjunction with FIGS. 2 and 3.

The frame buffer(s) are used to refresh one or more displays (e.g., display devices) or the frame buffer(s) may be in a system RAM (e.g., RAM 105). Typically, the input/output devices 110 are coupled to the system through input/output controllers 109. The volatile RAM 105 is typically implemented as dynamic RAM (DRAM) which requires power continually in order to refresh or maintain the data in the memory. The non-volatile memory 106 is typically a magnetic hard drive or a magnetic optical drive or an optical drive or a DVD RAM or other type of memory systems which maintain data even after power is removed from the system. Typically, the non-volatile memory will also be a random access memory although this is not required. While FIG. 1 shows that the non-volatile memory is a local device coupled directly to the rest of the components in the data processing system, it will be appreciated that the present disclosure may utilize a non-volatile memory which is remote from the system, such as a network storage device which is coupled to the data processing system through a network interface such as a modem or Ethernet interface. The bus 102 may include one or more buses connected to each other through various bridges, controllers and/or adapters as is well known in the art. In one embodiment the I/O controller 109 includes a USB (Universal Serial Bus) adapter for controlling USB peripherals, and/or an IEEE-1394 bus adapter for controlling IEEE-1394 peripherals.

It will be apparent from this description that aspects of the present disclosure may be embodied, at least in part, in software. That is, the techniques may be carried out in a computer system or other data processing system in response to its one or more processing units, such as a microprocessor, executing sequences of instructions contained in a memory, such as ROM 107, volatile RAM 105, non-volatile memory 106, cache 104 or a remote storage device. In various embodiments, hardwired circuitry may be used in combination with software instructions to implement the present disclosure. Thus, the techniques are not limited to any specific combination of hardware circuitry and software nor to any particular source for the instructions executed by the data processing system. In addition, throughout this description, various functions and operations are described as being performed by or caused by software code to simplify description. However, those skilled in the art will recognize what is meant by such expressions is that the functions result from execution of the code by a processor, such as the one or more processing units 103.

In the case of a small source gamut and wide destination gamut, at least one embodiment of the present invention replaces the source gamut with a new gamut, referred to as a virtual gamut, which is larger than a threshold value considered acceptable for any color correction operation in a non-color managed device or non-color managed application. The delay in color management in color matching from an excessively small gamut to a large gamut is avoided and the quality of the resulting colors is improved. A limit gamut may be chosen as the maximum acceptable color gamut for a device for all color correction operations. The limit gamut has the maximum area that the virtual gamut may obtain in which the unmanaged color data still appears visually pleasant.

In a color matching operation, if the source profile is equal to the destination profile there is no color matching operation performed in one embodiment. If the source profile is different from destination profile, a color matching operation from source to destination is performed. Typically, a profile of a device contains: 1) a look up table for converting color components represented in a device dependent color space for the device to color components represented in a device independent color space; and 2) an inverse look up table for converting color components represented in the device independent color space back to color components represented in the device dependent color space for the device.

FIG. 2 illustrates a graphics architecture in accordance with one embodiment. The graphics architecture 200 includes a windows backing store (WBS) 210, an assembly buffer (ASB) 212, a frame buffer 214, a look-up table (e.g., video-card LUT (vLUT)) 216, and a display device 220. Applications are drawn to the window backing store (WBS) 210. There are two types of applications that can be drawn into the WBS: unmanaged (no color management) applications 102 and color managed applications 204. Unmanaged color data applications 102 can include web browsing applications and applications that need to be drawn quickly. In this case, colors are drawn directly (i.e., unmatched) in the WBS 210 with the processing units (e.g., 103).

Managed color data applications can include applications for generating documents, spreadsheets, presentations, photo collections, videos, etc. In this case, color data is matched from a source profile of each element of the image to the destination profile that is the profile of the WBS. This may be a relatively costly operation based on being performed by the central processing unit (CPU), such as processing units 103, at the time of drawing. Conventionally, the display profile is assigned to the WBS 210.

Next, all windows backing stores are composed into the assembly buffer (ASB) 212. The data is color data matched at a high speed from WBS 210 to ASB 212. This may be a low cost operation done in the graphics processing units 113 (GPU). Conventionally, the display profile is assigned to the ASB.

Then, the data of the ASB 212 is transferred to frame buffer (FB) 214. Optionally, the FB 214 is assigned the display profile and the color data is matched between the ASB 212 and FB 214 at high speed in the GPU. In the FB 214 the data may be drawn directly for some game applications, applications services (e.g., Open GL applications), or video drivers. Conventionally, the display profile is assigned to the FB 214.

Gamma correction in a look-up table (e.g., videocard LUT or vLUT) is the last operation involving the translation of the FB content to the display device 220. This is required for converting the color data from a target transfer function (e.g., gamma 2.2) to a display native transfer function. In one embodiment, one vLUT is assigned for each display device in a system.

The display device 220 displays color data. The range of colors produced on a display device is called the real gamut or display color gamut. The display color gamut can vary from a small gamut (e.g., notebooks computers) to a medium gamut (e.g., standard RGB color space (sRGB)) to a large gamut (e.g., wide gamut displays (WGD)).

A conventional color management pipeline has a single profile (e.g., the display profile) assigned to a windows backing stores (WBS), an assembly buffer (ASB), and a frame buffer (FB). This ensures that there is no color matching operation performed between the WBS, the ASB, and the FB. For managed color data applications, the colors are shown correctly on the display because they are controlled by the source profile assigned to the source color data. For unmanaged color data applications, if the display device is a small or medium gamut display, then there are likely no visually objectionable colors shown on the display device. However, if the display device is a wide gamut display, then unmanaged color data likely generates visually objectionable colors on the display. The source color data may be over-saturated when displayed on a wide gamut display.

In one embodiment, a novel method assigns to the WBS 210 a new gamut profile, which may be referred to as a virtual gamut profile 211. The virtual gamut profile 211 is computed dynamically per display when a display is connected to the system. The virtual gamut profile 211 may be computed as a function of the color gamut of the WGD.

Figure 3:
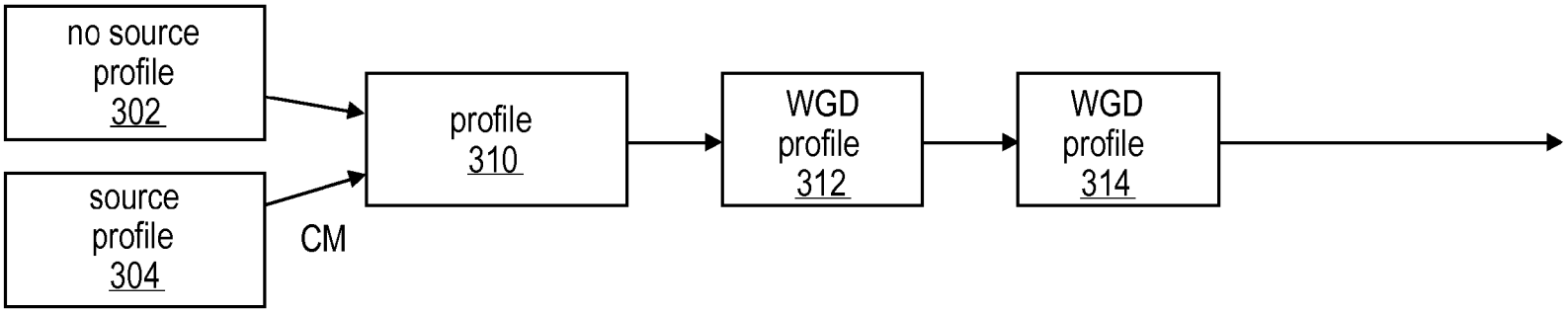
FIG. 3 illustrates a color management pipeline in accordance with one embodiment of the present invention.

FIG. 3 illustrates a color management pipeline in accordance with one embodiment of the present invention. A virtual gamut profile 310 is assigned to a window backing stores (WBS), a wide gamut profile 312 is assigned to an assembly buffer (ASB) and a frame buffer (FB). For managed color data applications, the colors are shown correctly on a display because they are controlled by the source profile 304 assigned to the source color data. For a large gamut source profile, the colors are limited by color matching to the color gamut defined by the virtual gamut profile.

For unmanaged color data applications, the virtual gamut profile 310 replaces or substitutes for a real gamut profile of the display device. An advantage of this solution is that for unmanaged color data applications 302 there is no processing intensive and time consuming color match from the application space to the WBS. The color data in the WBS is matched at a high speed from the virtual gamut profile of the WBS to the ASB display profile 312, then passed unmatched to the FB 314 to the display. The displayed color is only slightly boosted, not as much as for direct display on the WGD, because the virtual gamut of the virtual gamut profile is smaller than wide gamut of a WGD. The non-color managed system can quickly display color data from unmanaged color data applications.

In contrast, a color management operation may involve various color manipulations, such as converting colors from one color space to another color space (e.g., from a device dependent color space to a device independent color space, from a device independent color space to a device dependent color space, from a device dependent color space to another device dependent color space, or from a device dependent color space for one device to the device dependent color space for another device).

Figure 4:
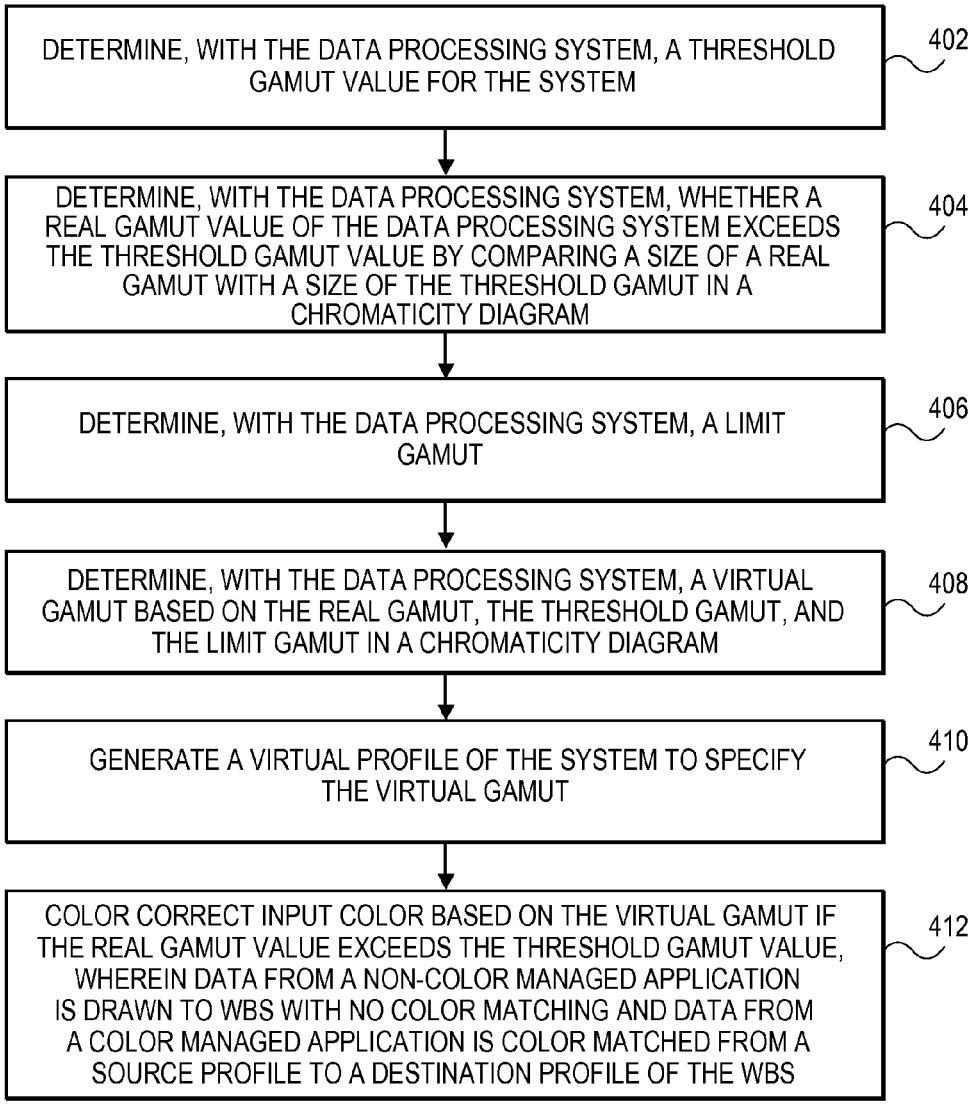
FIG. 4 illustrates a flow diagram in one embodiment of the present invention for a computer-implemented method 400 of providing color correction for a data processing system.

FIG. 4 illustrates a flow diagram in one embodiment of the present invention for a computer-implemented method 400 of providing color correction for a data processing system. The computer-implemented method 400 is performed by processing logic that may comprise hardware (circuitry, dedicated logic, etc.), software (such as is run on a general purpose computer system or a dedicated machine or a system), or a combination of both.

At block 402, the processing logic determines, with the data processing system, a threshold gamut value for the system. The threshold gamut value may be based on a predefined gamut (e.g., a standard RGB color space (sRGB)), which is independent of the real gamut for the system. Alternatively, the threshold gamut value may be set based on a visual preference of a user. For example, the user may desire that the threshold gamut is slightly or somewhat larger by a certain percentage than the gamut of sRGB. In another embodiment, the threshold gamut is determined by the user as a function of the preferences determined in specific viewing conditions in which the real device is seen. For example, a viewing condition with too much light or numerous displays may influence the setting of the threshold gamut in order to avoid color distortion on the system or a device (e.g., display device) of the system. The viewing conditions may refer also to the case when the unmanaged colors on the real device are seen in side by side comparison with colors shown on other display devices. In this case, the user preference for selection of the threshold gamut may depend on how much boosting the user considers acceptable such that the unmanaged colors are displayed without objectionable vividness that may be interpreted as unnatural color, especially in case of memory colors such as color of grass, sky, human skin, etc. At block 404, the processing logic determines, with the data processing system, whether a real gamut value (e.g. the real gamut of an application which does not use a color managed system) exceeds the threshold gamut value by comparing a size of a real gamut with a size of the threshold gamut in a chromaticity diagram. At block 406, the processing logic determines, with the data processing system, a limit gamut. At block 408, in one embodiment, the processing logic determines, with the data processing system, a virtual gamut based on the real gamut, the threshold gamut, and the limit gamut in a chromaticity diagram. The processing logic may determine a size of the virtual gamut from a size of the real gamut, a size of the threshold gamut, and a size of the limit gamut. The virtual gamut may have a size that is greater than the size of the threshold gamut and less than the size of the limit gamut. At block 410, the processing logic generates a virtual profile of the system or a device of the system to specify the virtual gamut. At block 412, the processing logic color corrects input color based on the virtual gamut if the real gamut value exceeds the threshold gamut value. Data from an application that is not color managed may be drawn to a windows backing store (WBS) with no color matching operation and data from an application that is color managed may be color matched from a source profile to a destination profile of the windows backing store (WBS). The color correcting includes adjusting the input color in a system such that a non-color managed application (e.g. a web browser) does not use color management for drawing the data to the windows backing store. An embodiment of the invention can simultaneously support both color managed and non color managed applications on the same data processing system.

A virtual gamut profile may be associated with the window backing store (WBS). By design, the virtual gamut is smaller than the real gamut and larger than the threshold gamut. The virtual gamut size is selected such that a visually acceptable color can be obtained in the following two cases. For the first case, any unmanaged color from an unmanaged color application to WBS is matched from WBS to ASB by fast GPU processing. The matching from the smaller virtual gamut of WBS to a larger real gamut of ASB ensures that the unnatural vividness of the unmatched color is reduced to a visually acceptable color. For the second case, any matched color from the source profile (potentially with larger gamut than the WBS gamut) of the color managed application to the WBS virtual color gamut results in a gamut compression, and from the WBS virtual gamut to the real device gamut into a gamut decompression. The WBS virtual gamut size is determined such that the compression/decompression with conventional known matching methods produces a visually acceptable color.

Figure 5:
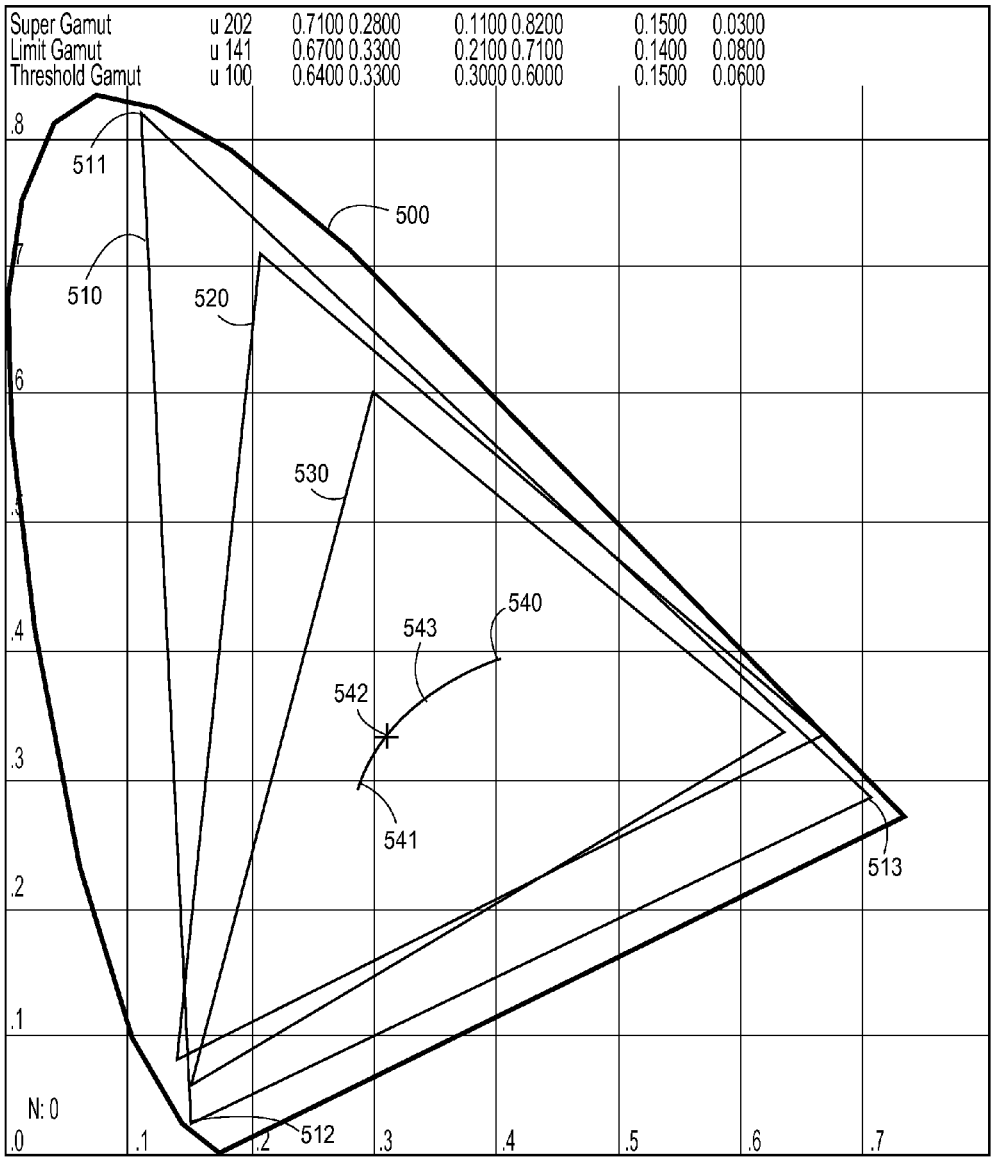
FIGS. 5-10 illustrate chromaticity diagrams showing various gamuts of a system in accordance with one embodiment of the present invention.

FIGS. 5-10 illustrate chromaticity diagrams showing gamuts of a system in accordance with one embodiment of the present invention. The horseshoe-shaped CIE 1931 XYZ color space 500, created by the International Commission on Illumination (CIE), represents the colors visible to a standard observer. The color space 500 includes a black body locus or white point locus 540 with color temperatures 541-543 indicated. Color temperature 543 represents 5000 K Daylight (D50), color temperature 542 represents 6500 K Daylight (D65), and color temperature 541 represents a 9300 K TV screen (analog). Super gamut 510 represents a large gamut for a display device of the system. The gamut 510 represents the largest area of a practical device in accordance with one embodiment of the invention. Points 511-513 represent the positions of the three primaries (red, green, blue) of a device with the super gamut. The colors that can be produced by the device with super gamut are within the triangle defined by points 511-513. For example, the super gamut may be the maximum area of a triangle that can be included in the chromaticity diagram. In one embodiment, the super gamut is based on a triangle that is defined by the primaries Red (0.71, 0.28), Green (0.11, 0.82), and Blue (0.15, 0.03) as shown in FIG. 5. The super gamut is not limited to the chromaticity diagram, it can be a triangle with the primaries on the border of the chromaticity diagram or even outside of the chromaticity diagram.

The limit gamut 520 represents the maximum area that a virtual gamut may reach such that the unmanaged color data associated with a non-color managed application can still look reasonably well on the real display device. At the same time, the color managed data associated with a large gamut source profile from a color managed application will not be significantly limited when matched to the virtual gamut and then rematched to the real device color gamut. In one embodiment, the limit gamut is based on the National Television System Committee (NTSC) color space or set equal to the NTSC gamut. In another embodiment, the limit gamut is based on the Adobe RGB color space or set equal to the Adobe RGB gamut.

A threshold gamut 530 has an area that is used as a threshold value. In one embodiment, the threshold gamut is based on the sRGB gamut or set equal to the sRGB gamut. Real gamuts for devices (e.g., wide gamut devices) having larger values than the threshold value will be replaced with a virtual gamut using the following equation.

$$A_V = A_T + (A - A_T)\cdot(A_L - A_T)/(A_S - A_T)$$

A is the area of the real gamut for the display device, $A_V$ is the area of the virtual gamut, $A_T$ is the area of the threshold gamut, $A_S$ is the area of a super large gamut in the chromaticity diagram, and $A_L$ is the area of the maximum limit of the virtual gamut. The equation shows that when the real gamut is larger than the threshold gamut ($A_T$) then the virtual gamut area ($A_V$) will be larger than (or equal to) the threshold gamut and smaller than (or equal to) the area of the limit gamut ($A_L$). The virtual gamut area is correlated to the size of the real gamut. The virtual gamut can be found by progressively reducing its area until the value defined by equation is reached.

Figure 6:
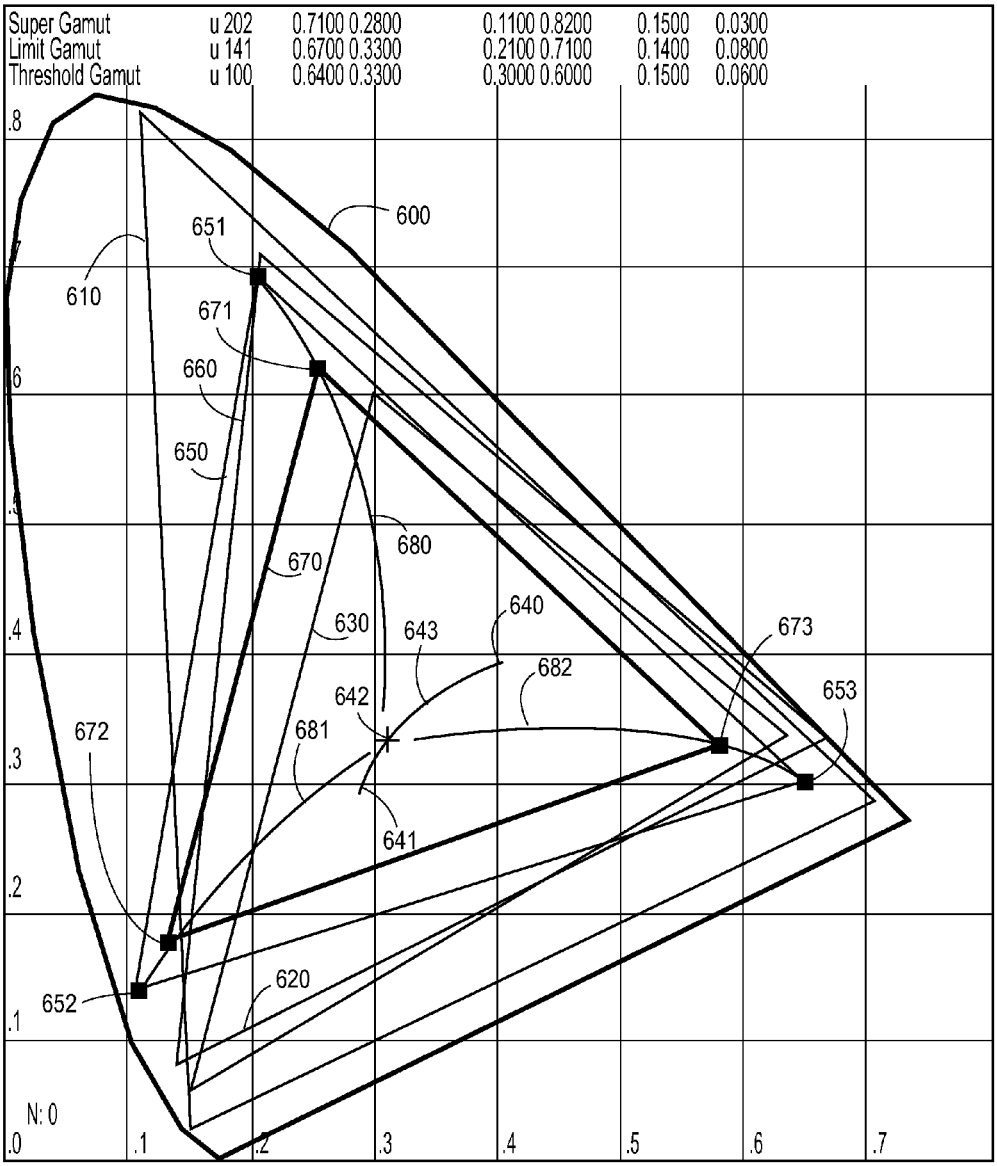

FIG. 6 illustrates this process for determining the virtual gamut in accordance with one embodiment of the present invention. The CIE color space 600 is drawn to include a black body locus or white point locus 640 with color temperatures 641-643 indicated, a super gamut 610, a limit gamut 620, a threshold gamut 630, a real gamut 650, and a virtual gamut 670. Color temperature 643 represents 5000 K Daylight (D50), color temperature 642 represents 6500 K Daylight (D65), and color temperature 641 represents a 9300 K TV screen (analog). The process includes starting with the virtual gamut primaries equal to the real gamut primaries (e.g., 651-653) and then moving these primaries toward the center of the chromaticity diagram in small increments along the constant hue lines (e.g., 680-682) corresponding to the primaries of the real gamut. In this process, the area of the virtual gamut 670 decreases and the process stops when the virtual gamut area is equal to or smaller than the value calculated by the equation. The virtual gamut area is defined by the triangle having primaries 671-673. The area of a gamut (e.g., real gamut 650) can be a quality indicator for the gamut. A pleasing image can be generated such that the unmanaged color data can still look reasonably well on the real display device while the color managed data associated with a large gamut source profile from a color managed application will not be significantly limited when matched to the virtual gamut and then rematched to the real device color gamut. Thus, the area of a real gamut can be used to construct a virtual gamut having an area less than a limit gamut and greater than a threshold gamut.

Figure 7:
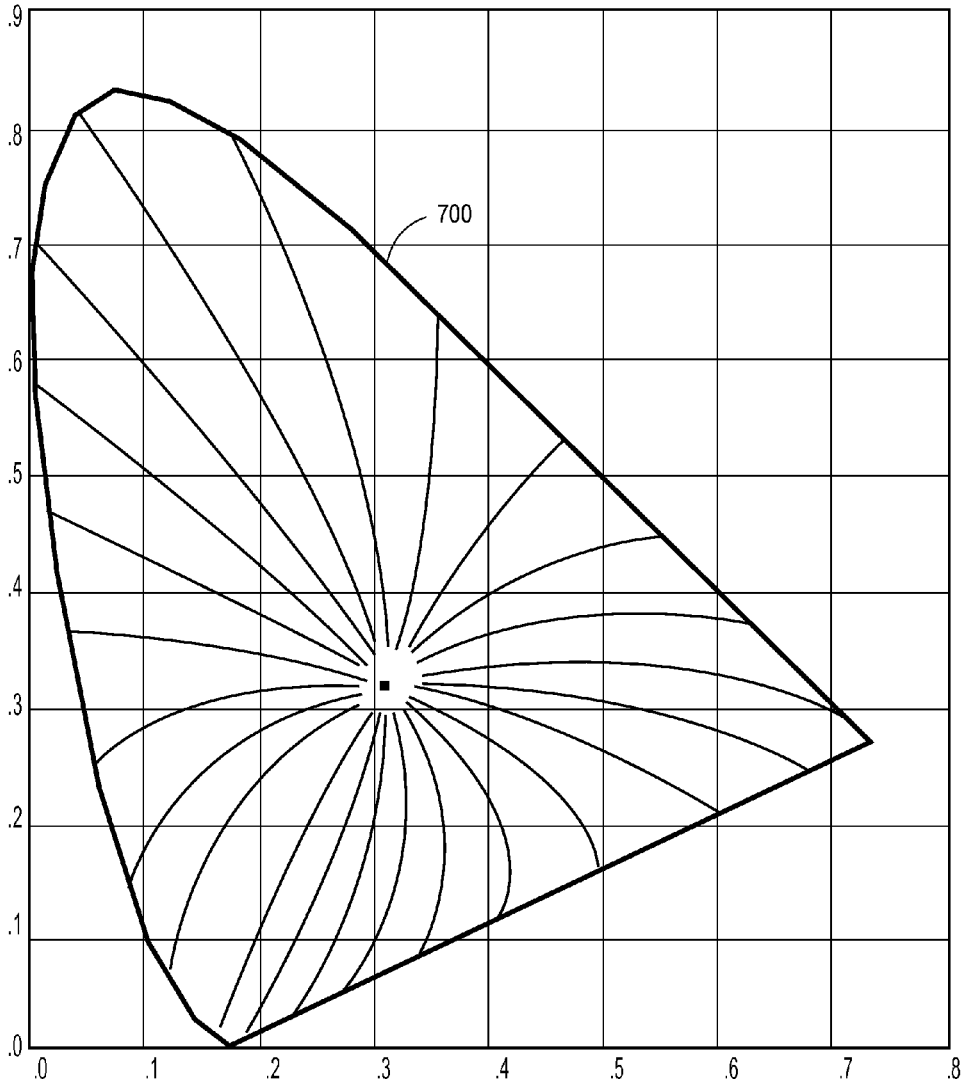

FIGS. 7-10 illustrate a method of determining a virtual gamut according to one embodiment of the present invention. FIG. 7 illustrates constant hue lines in a chromaticity diagram 700 which may be used for determining a virtual gamut according to one embodiment of the present invention. The constant hue loci in the chromaticity diagram can be determined using the procedure of determining the geodesic curves as described in "*Color Science: Concepts and Methods, Quantitative Data and Formulae*" by G. Wyszecki and W. S. Stiles.

Figure 8:
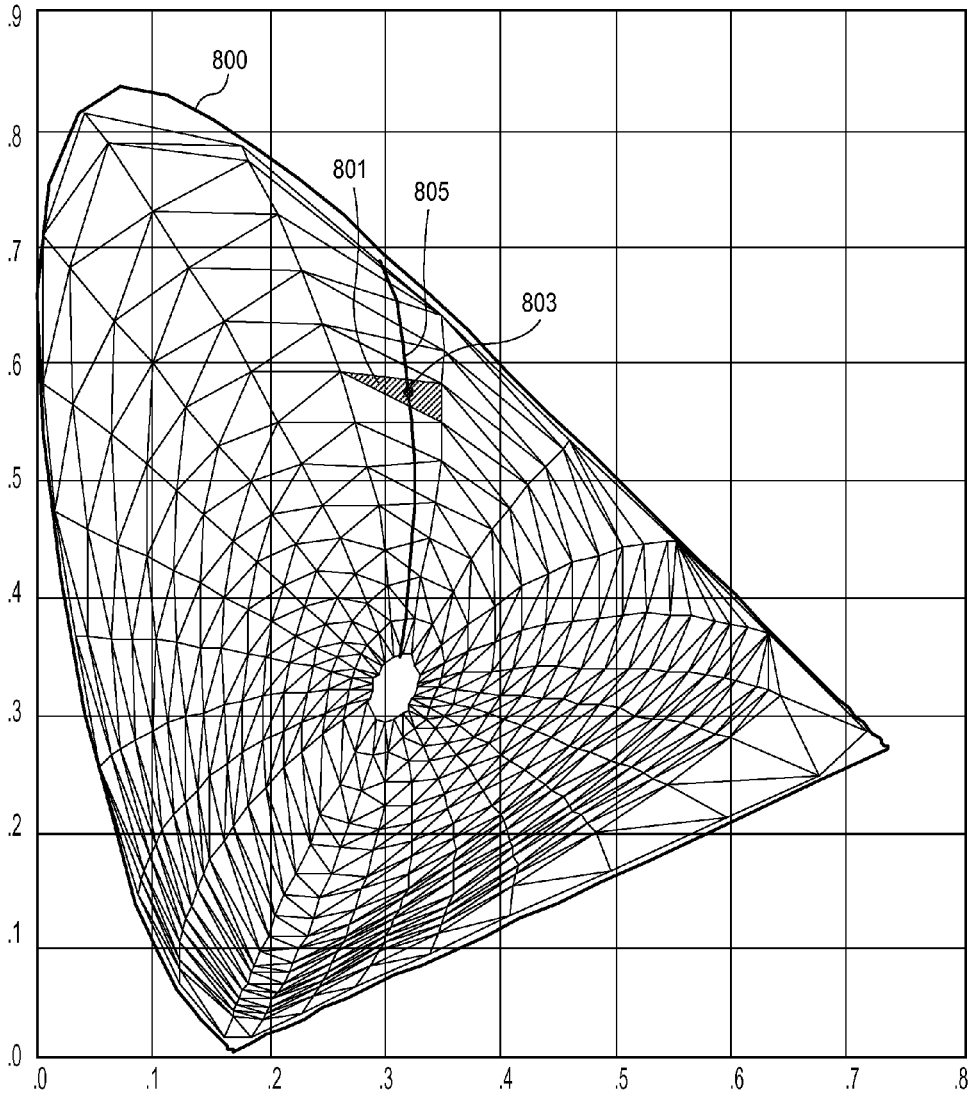

FIG. 8 illustrates an example of partitioning a chromaticity diagram 800 with triangles for generating constant hue lines that are passing primaries of a real gamut according to one embodiment of the present invention. An arbitrary chromaticity point P(x,y) is located in a triangle of this partition. If the point is located on a border of triangle (e.g., lines or vertices), then the first triangle containing the point is selected. For example, based on the intersection points of hue lines and saturation lines, a mesh of triangles can be used to locate a primary of the real gamut. Triangle 801 that contains point 803, which is a primary of the real gamut, can be identified through a search operation. Then, constant hue line 805, which passes through primary 803, can be determined from the mesh of the triangles.

Figure 9:
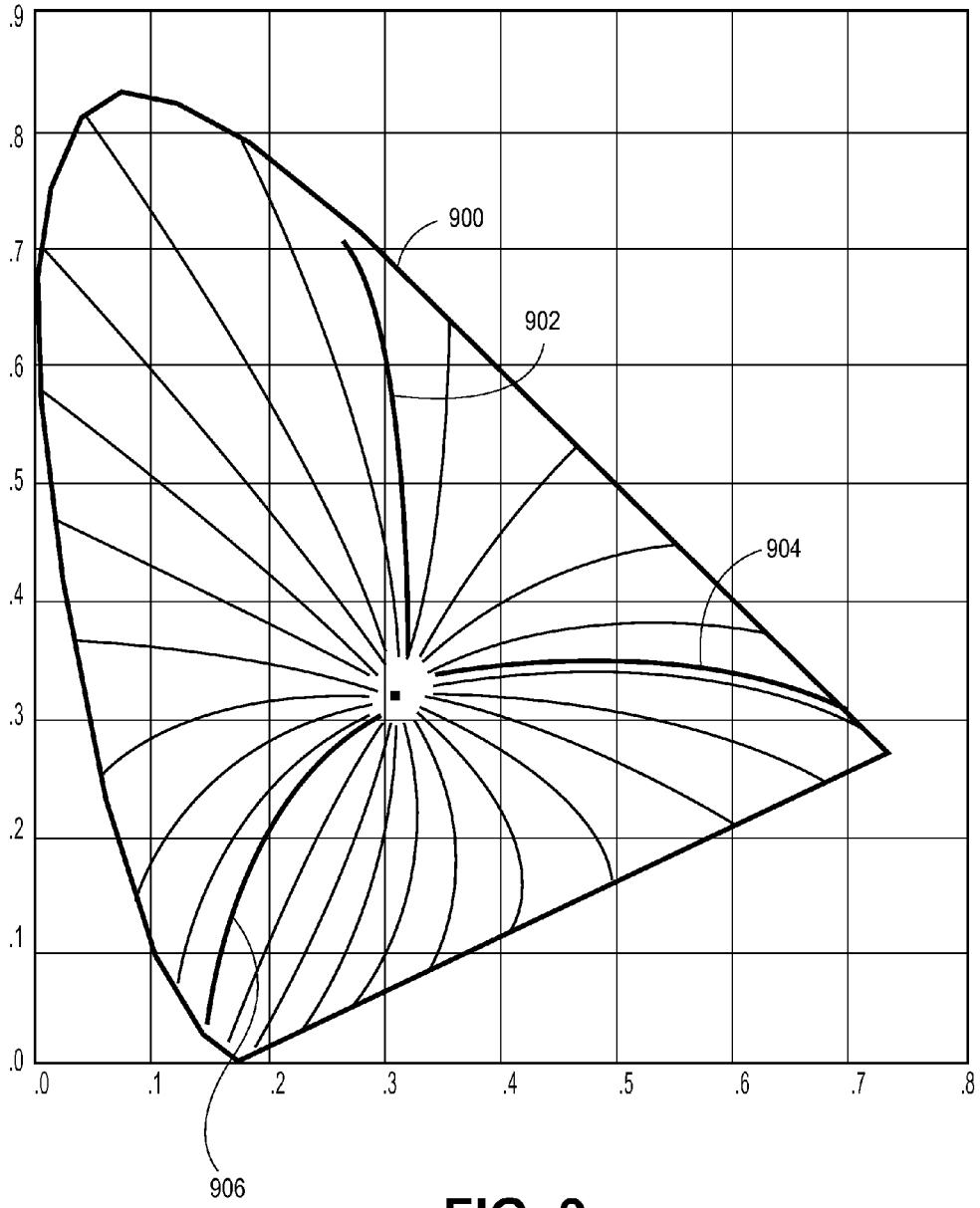
Figure 10:
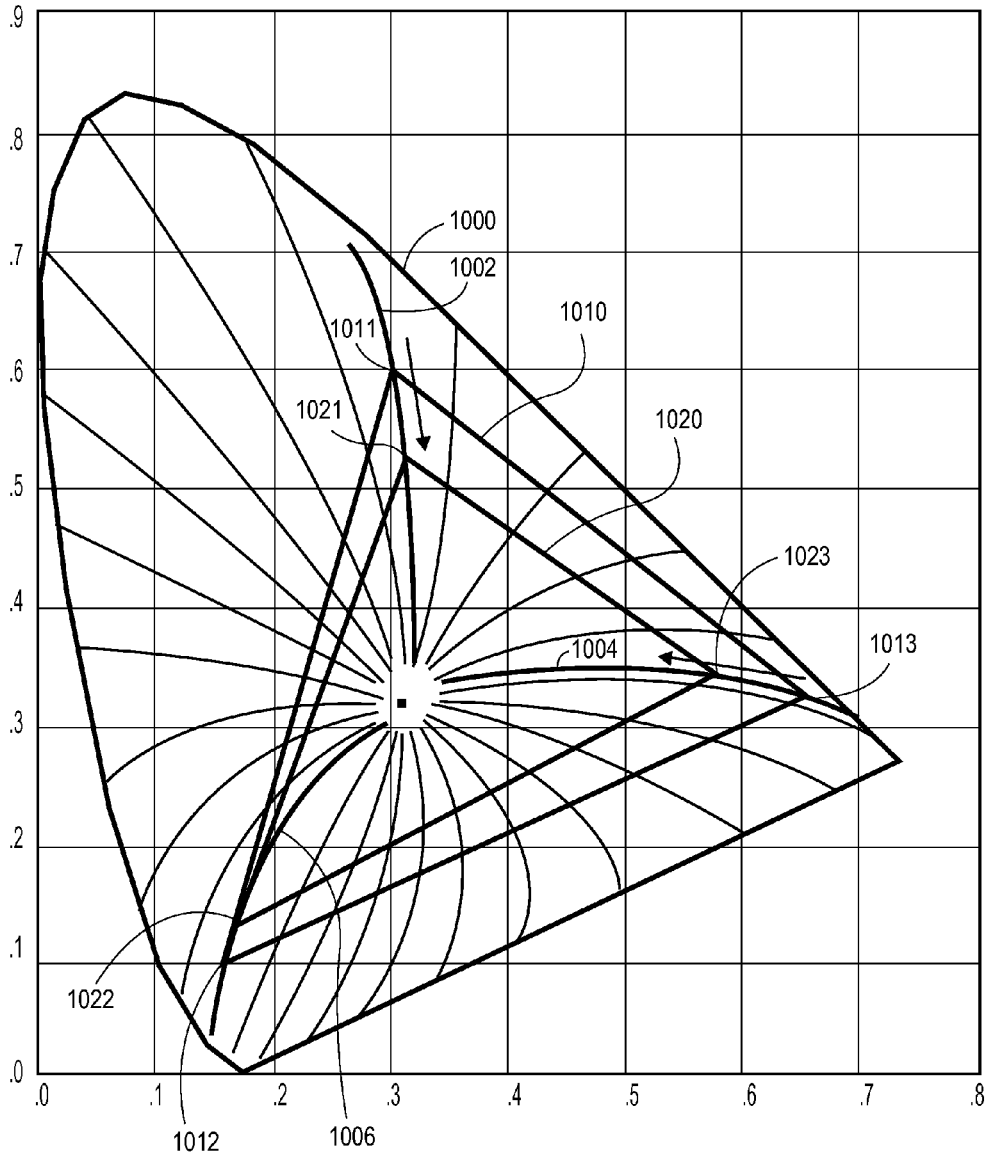

FIG. 9 illustrates that for any arbitrary set of three chromaticity points (x, y) located in the diagram 900, it is possible to derive three constant hue lines (e.g., 902, 904, 906). FIG. 10 illustrates the determination of the virtual gamut by shrinking or reducing an area of a real gamut 1010 along constant hue lines (e.g., 1002, 1004, 1006) corresponding to the primaries (e.g., 1011-1013) of the real gamut 1010. The shrinking or reducing process is performed incrementally until an area of a virtual gamut 1020 reaches a desired value in accordance with the above equation. In one embodiment, the desired value is an area of the virtual gamut 1020 that is based on the triangle defined by primaries 1021-1023. FIGS. 7-10 illustrate the derivation of the constant hue lines and virtual gamut in FIG. 6.

Although the present invention is illustrated using an area in a CIE chromaticity diagram, it will be apparent to one skilled in the art from this description that the same approach can be used in other device independent color spaces to quantify the size of the gamut of a device. For example, gamut volume in one color space (e.g., a XYZ or L*a*b* color space) can be used, instead of gamut area, as a measure of device reproduction capability. In such a case, the areas of the real, threshold, limit and virtual gamuts can be replaced with the volumes of the real, threshold, limit and virtual gamuts.

Notice that the area of a gamut can be calculated directly from the coordinates of corner points (the locations of the primaries) of the gamut on the chromaticity diagram. It may also be computed using a proper metric system. For example, in one metric system, if two neighboring points are just noticeably different colors on the chromaticity diagram, the line element connecting the two points has the same constant value along its length. When such a metric system is used, the area can be computed from a weighted area integral on the gamut. From this description, it will be apparent to one skilled in the art that gamut volume can be calculated in different color spaces, such as XYZ or L*a*b* or other tri-dimensional color spaces.

Figure 11:
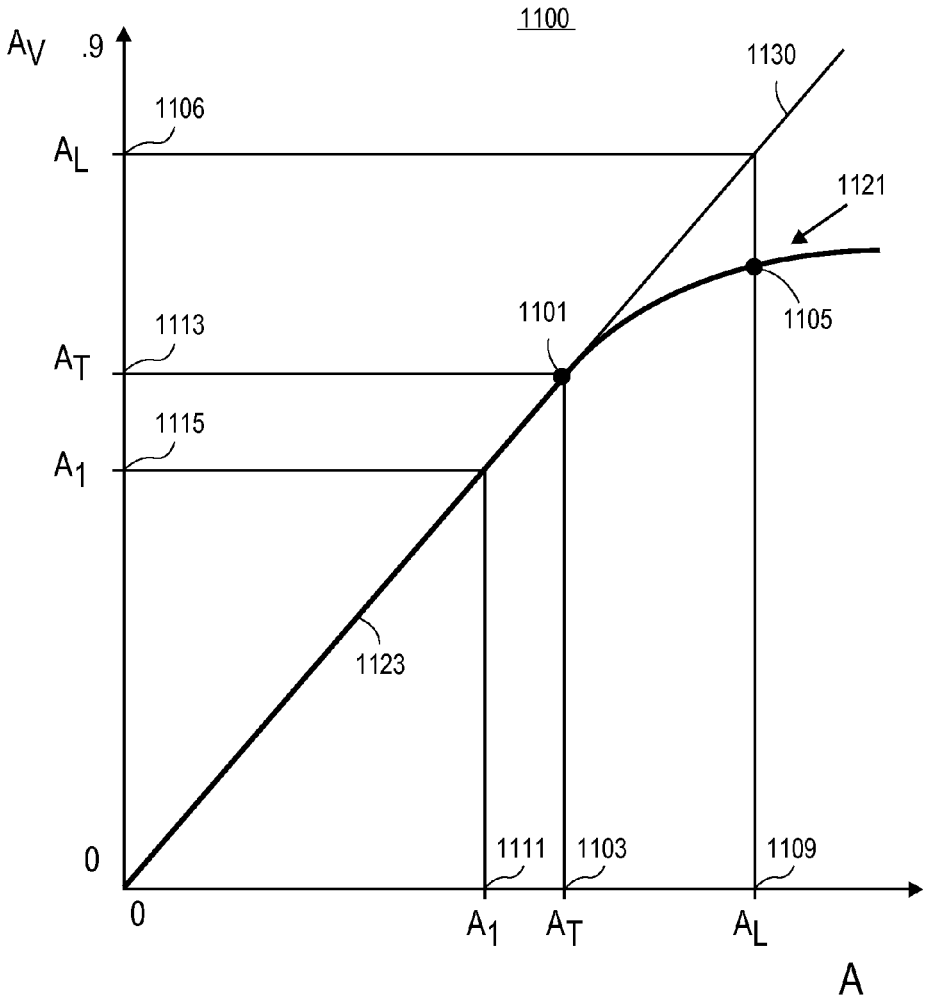
FIG. 11 illustrates a method of generating the area of a virtual gamut for a device with a wide gamut according to one embodiment of the present invention.

FIG. 11 illustrates a method of generating the area of a virtual gamut for a device with a wide gamut according to one embodiment of the present invention. A function of two segments (1121 and 1123) joining at point 1101 can be used to map an area of a real gamut (A) to a desirable area of a virtual gamut ($A_V$). Segment 1121 may be referred to as a replacement segment because it replaces the linear segment 1130. When the area of the real gamut is less than a threshold ($A_T$ 1103), the desirable area ($A_V$) of the gamut of the device is equal to the real area (A) of the real gamut of the device. For example, real area $A_1$ 1111 is mapped to desirable area $A_1$ 1115 by segment 1123. In this case, no color correction of input color data occurs. In one embodiment, the threshold may be based on or defined by the sRGB color space. When the area of the real gamut is larger than the threshold ($A_T$ 1103), a function defined by segment 1121 maps the real gamut area to a desirable virtual gamut area that is less than the real gamut area and greater than the threshold gamut area.

In one embodiment of the present invention, the mapping function of segments 1121 and 1123 is a monotonic continuous function such that a larger real gamut area (A) is mapped into a smaller desirable virtual gamut area ($A_V$) in order to maintain the monotonic color performance of the devices and prevent over-saturation as described earlier. For example, a linear function (or a quadratic function) between points 1101 and 1105 can be used for segment 1121.

In another embodiment of the present invention, a limit gamut area ($A_L$) is used to specify the maximum acceptable value for a desirable gamut area. Thus, any real gamut area larger than the threshold area ($A_T$ 1103) will be mapped to a desirable gamut area that is smaller than the limit gamut area ($A_L$ 1106). In one example, the limit gamut area ($A_L$) is the same as the threshold area ($A_T$) such that any real gamut area larger than the threshold area will be mapped to the threshold area.

In other embodiments of the present invention, various different forms of functions can be used for mapping the real gamut area to the desirable gamut area. For example, the equation discussed above can be used for segment 1121.

Figure 12:
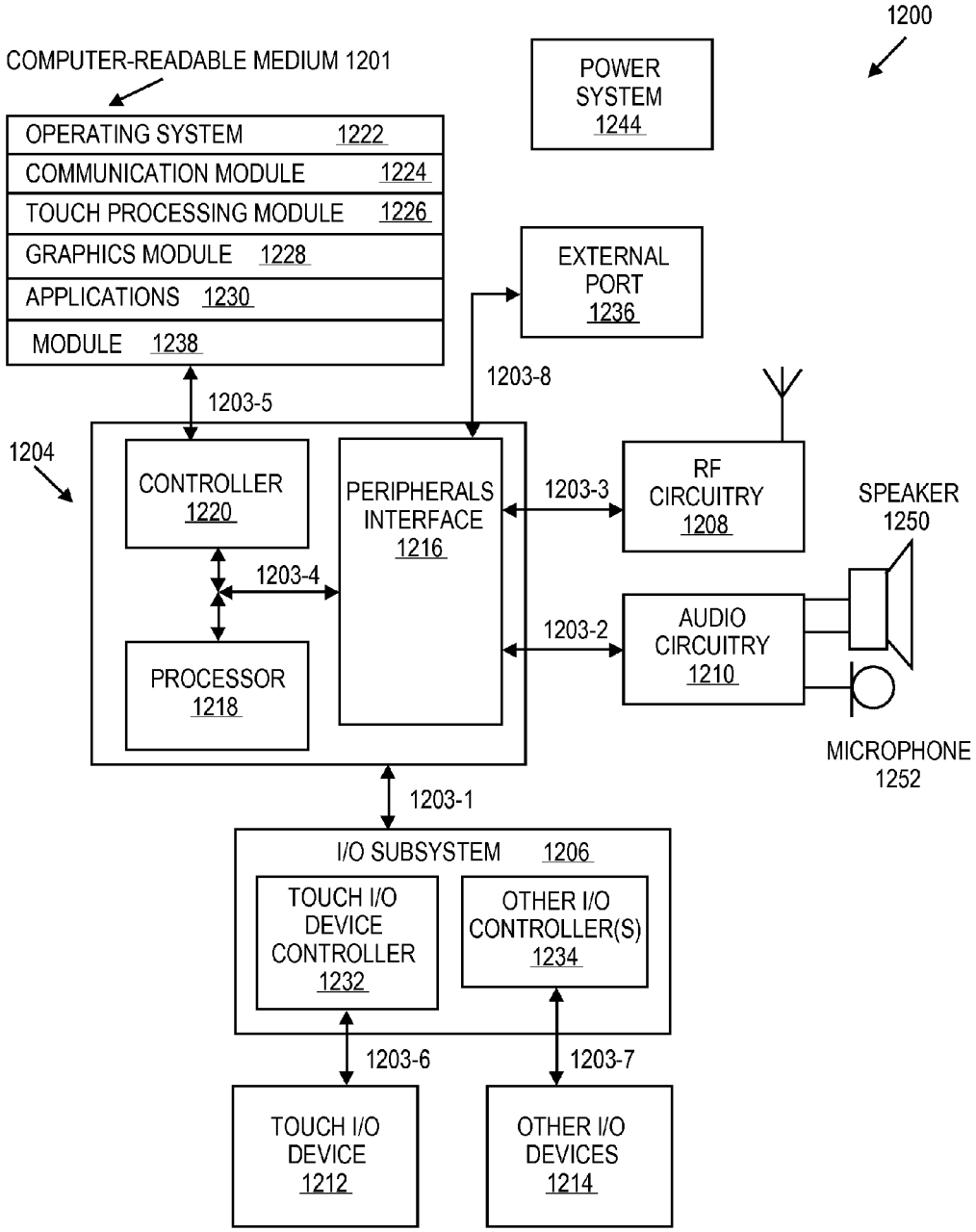
FIG. 12 is a block diagram of system 1200 in accordance with one embodiment of the present invention.

Attention is now directed towards embodiments of a system architecture that may be embodied within any portable or non-portable device including but not limited to a communication device (e.g. mobile phone, smart phone), a multimedia device (e.g., MP3 player, TV, radio), a portable or handheld computer (e.g., tablet, netbook, laptop), a desktop computer, an All-In-One desktop, a peripheral device, or any other system or device adaptable to the inclusion of system architecture 1200, including combinations of two or more of these types of devices. FIG. 12 is a block diagram of one embodiment of the present invention of system 1200 that generally includes one or more computer-readable mediums 1201, processing system 1204, Input/Output (I/O) subsystem 1206, radio frequency (RF) circuitry 1208 and audio circuitry 1210. These components may be coupled by one or more communication buses or signal lines 1203.

It should be apparent that the architecture shown in FIG. 12 is only one example architecture of system 1200, and that system 1200 could have more or fewer components than shown, or a different configuration of components. The various components shown in FIG. 12 can be implemented in hardware, software, firmware or any combination thereof, including one or more signal processing and/or application specific integrated circuits.

RF circuitry 1208 is used to send and receive information over a wireless link or network to one or more other devices and includes well-known circuitry for performing this function. RF circuitry 1208 and audio circuitry 1210 are coupled to processing system 1204 via peripherals interface 1216. Interface 1216 includes various known components for establishing and maintaining communication between peripherals and processing system 1204. Audio circuitry 1210 is coupled to audio speaker 1250 and microphone 1252 and includes known circuitry for processing voice signals received from interface 1216 to enable a user to communicate in real-time with other users. In some embodiments, audio circuitry 1210 includes a headphone jack (not shown).

Peripherals interface 1216 couples the input and output peripherals of the system to processor 1218 and computer-readable medium 1201. One or more processing units 1218 (e.g., CPU, GPU) communicate with one or more computer-readable mediums 1201 via controller 1220. Computer-readable medium 1201 can be any device or medium (e.g., storage device, storage medium) that can store code and/or data for use by one or more processing units 1218. Medium 1201 can include a memory hierarchy, including but not limited to cache, main memory and secondary memory. The memory hierarchy can be implemented using any combination of RAM (e.g., SRAM, DRAM, DDRAM), ROM, FLASH, magnetic and/or optical storage devices, such as disk drives, magnetic tape, CDs (compact disks) and DVDs (digital video discs). Medium 1201 may also include a transmission medium for carrying information-bearing signals indicative of computer instructions or data (with or without a carrier wave upon which the signals are modulated). For example, the transmission medium may include a communications network, including but not limited to the Internet (also referred to as the World Wide Web), intranet(s), Local Area Networks (LANs), Wide Local Area Networks (WLANs), Storage Area Networks (SANs), Metropolitan Area Networks (MAN) and the like.

One or more processing units 1218 run various software components stored in medium 1201 to perform various functions for system 1200. In some embodiments, the software components include operating system 1222, communication module (or set of instructions) 1224, touch processing module (or set of instructions) 1226, graphics module (or set of instructions) 1228, one or more applications (or set of instructions) 1230, and color correction module [or set of instructions] 1238. The color correction module corresponds to a set of instructions for performing one or more functions described above and the methods described in this application (e.g., the computer-implemented methods and other information processing methods described herein). These modules (i.e., sets of instructions) need not be implemented as separate software programs, procedures or modules, and thus various subsets of these modules may be combined or otherwise rearranged in various embodiments.

In some embodiments, medium 1201 may store a subset of the modules and data structures identified above. Furthermore, medium 1201 may store additional modules and data structures not described above.

Operating system 1222 includes various procedures, sets of instructions, software components and/or drivers for controlling and managing general system tasks (e.g., memory management, storage device control, power management, etc.) and facilitates communication between various hardware and software components.

Communication module 1224 facilitates communication with other devices over one or more external ports 1236 or via RF circuitry 1208 and includes various software components for handling data received from RF circuitry 1208 and/or external port 1236.

Graphics module 1228 includes various known software components for rendering, animating and displaying graphical objects on a display surface. In embodiments in which touch I/O device 1212 is a touch sensitive display (e.g., touch screen), graphics module 1228 includes components for rendering, displaying, and animating objects on the touch sensitive display.

One or more applications 1230 can include any applications installed on system 1200, including without limitation, a color management application, a color correction application, a browser, address book, contact list, email, instant messaging, word processing, keyboard emulation, widgets, JAVA-enabled applications, encryption, digital rights management, voice recognition, voice replication, location determination capability (such as that provided by the global positioning system (GPS)), a music player, etc.

Touch processing module 1226 includes various software components for performing various tasks associated with touch I/O device 1212 including but not limited to receiving and processing touch input received from I/O device 1212 via touch I/O device controller 1232.

System 1200 may further include color correction module 1238 for performing the method/functions as described herein in connection with FIGS. 1-12. In one embodiment, color correction module 1238 may at least function to determine a threshold gamut, to compare a real gamut with the threshold gamut, and to color correct input color based on the comparison. The color correcting includes adjusting the input color in the non-color managed system 1200 that may have a wide gamut display.

The color correcting of the input color based on the comparison occurs if the real gamut exceeds the threshold gamut. This comparison includes comparing a size of the real gamut with a size of the threshold gamut in a chromaticity diagram. The color correcting with the module 1238 may further include determining a limit gamut and determining a virtual gamut that has a size that is greater than the size of the threshold gamut and less than the size of the limit gamut. The threshold gamut value may be based on a standard RGB color space (sRGB). The virtual gamut may be determined based on a wide gamut display of the system, the threshold gamut, and the limit gamut in a chromaticity diagram. The size of the virtual gamut may be determined from a size of the wide gamut display, a size of the threshold gamut, and a size of the limit gamut. A primary color of the virtual gamut and a corresponding primary color of the wide gamut display may be on a hue locus.

Module 1238 may also interact with color correction application, color management application, or graphics module 1228 to provide the methods and functionality described herein. Module 1238 may be embodied as hardware, software, firmware, or any combination thereof. Although module 1238 is shown to reside within medium 1201, all or portions of module 1238 may be embodied within other components within system 1200 or may be wholly embodied as a separate component within system 1200.

I/O subsystem 1206 is coupled to touch I/O device 1212 and one or more other I/O devices 1214 for controlling or performing various functions. Touch I/O device 1212 communicates with processing system 1204 via touch I/O device controller 1232, which includes various components for processing user touch input (e.g., scanning hardware). One or more other input controllers 1234 receives/sends electrical signals from/to other I/O devices 1214. Other I/O devices 1214 may include physical buttons, dials, slider switches, sticks, keyboards, touch pads, additional display screens, or any combination thereof.

If embodied as a touch screen, touch I/O device 1212 displays visual output to the user in a GUI. The visual output may include text, graphics, video, and any combination thereof. Some or all of the visual output may correspond to user-interface objects. Touch I/O device 1212 forms a touch-sensitive surface that accepts touch input from the user. Touch I/O device 1212 and touch screen controller 1232 (along with any associated modules and/or sets of instructions in medium 1201) detects and tracks touches or near touches (and any movement or release of the touch) on touch I/O device 1212 and converts the detected touch input into interaction with graphical objects, such as one or more user-interface objects. In the case in which device 1212 is embodied as a touch screen, the user can directly interact with graphical objects that are displayed on the touch screen. Alternatively, in the case in which device 1212 is embodied as a touch device other than a touch screen (e.g., a touch pad), the user may indirectly interact with graphical objects that are displayed on a separate display screen embodied as I/O device 1214.

Embodiments in which touch I/O device 1212 is a touch screen, the touch screen may use LCD (liquid crystal display) technology, LPD (light emitting polymer display) technology, OLED (organic LED), or OEL (organic electro luminescence), although other display technologies may be used in other embodiments.

Feedback may be provided by touch I/O device 1212 based on the user's touch input as well as a state or states of what is being displayed and/or of the computing system. Feedback may be transmitted optically (e.g., light signal or displayed image), mechanically (e.g., haptic feedback, touch feedback, force feedback, or the like), electrically (e.g., electrical stimulation), olfactory, acoustically (e.g., beep or the like), or the like or any combination thereof and in a variable or non-variable manner.

System 1200 also includes power system 1244 for powering the various hardware components and may include a power management system, one or more power sources, a recharging system, a power failure detection circuit, a power converter or inverter, a power status indicator and any other components typically associated with the generation, management and distribution of power in portable devices.

In some embodiments, peripherals interface 1216, one or more processing units 1218, and memory controller 1220 may be implemented on a single chip, such as processing system 1204. In some other embodiments, they may be implemented on separate chips.

In certain embodiments of the present disclosure, the system 101 or system 1200 or combinations of systems 101 or 1200 can be used to implement at least some of the methods discussed in the present disclosure.

Some portions of the detailed descriptions are presented in terms of algorithms which include operations on data stored within a computer memory. An algorithm is generally a self-consistent sequence of operations leading to a desired result. The operations typically require or involve physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, can refer to the action and processes of a data processing system, or similar electronic device, that manipulates and transforms data represented as physical (electronic) quantities within the system's registers and memories into other data similarly represented as physical quantities within the system's memories or registers or other such information storage, transmission or display devices.

The present disclosure can relate to an apparatus for performing one or more of the operations described herein. This apparatus may be specially constructed for the required purposes, or it may comprise a general purpose computer selectively activated or reconfigured by a computer program stored in the computer. Such a computer program may be stored in a machine (e.g. computer) readable storage medium, such as, but is not limited to, any type of disk including floppy disks, optical disks, CD-ROMs, and magnetic-optical disks, read-only memories (ROMs), random access memories (RAMs), erasable programmable ROMs (EPROMs), electrically erasable programmable ROMs (EEPROMs), flash memory, magnetic or optical cards, or any type of media suitable for storing electronic instructions, and each coupled to a bus.

A machine-readable medium includes any mechanism for storing or transmitting information in a form readable by a machine (e.g., a computer). For example, machines store and communicate (internally and with other devices over a network) code and data using machine-readable media, such as machine storage media (e.g., magnetic disks; optical disks; random access memory; read only memory; flash memory devices; phase-change memory). In the foregoing specification, the disclosure has been described with reference to specific exemplary embodiments thereof. It will be evident that various modifications may be made thereto without departing from the broader spirit and scope of the disclosure as set forth in the following claims. The specification and drawings are, accordingly, to be regarded in an illustrative sense rather than a restrictive sense.

What is claimed is:

1. A method to perform color correction on a data processing system, the method comprising:

determining, with the data processing system, a threshold gamut value;

determining, with the data processing system, whether a real gamut value of a display of the data processing system exceeds the threshold gamut value; and color correcting, with the data processing system, input color if the real gamut value exceeds the threshold gamut value, wherein the data processing system includes an application that is not color managed, wherein data from the application that is not color managed is drawn to a windows backing store with no color matching operation and a real gamut profile of the display is replaced with a virtual gamut profile for color correction of the data, wherein data from an application that is color managed is color matched to the virtual gamut profile and then rematched to the real gamut profile of the display, wherein the virtual gamut profile is different than the real gamut profile of the display.

2. The method as in claim 1 wherein the determining whether the real gamut value exceeds the threshold gamut value comprises comparing a size of a real gamut with a size of the threshold gamut in a chromaticity diagram and wherein the data processing system includes an application that is color managed.

3. The method as in claim 2 wherein color correcting further comprising:

determining, with the data processing system, a limit gamut; and determining, with the data processing system, a virtual gamut that has a size that is greater than the size of the threshold gamut and less than the size of the limit gamut.

4. The method as in claim 3 wherein the determining of the virtual gamut comprises:

determining the virtual gamut based on the real gamut, the threshold gamut, and the limit gamut in a chromaticity diagram.

5. The method as in claim 4 wherein the determining of the virtual gamut comprises:

determining a size of the virtual gamut from a size of the real gamut, a size of the threshold gamut, and a size of the limit gamut.

6. The method as in claim 5 wherein a primary color of the virtual gamut and a corresponding primary color of the real gamut are on a hue locus; and a saturation of the primary color of the virtual gamut is less than a saturation of the corresponding primary color of the real gamut.

7. The method as in claim 1 wherein data from the application that is color managed is color matched from a source profile to a destination profile of the windows backing store.

8. A non-transitory computer-readable medium containing executable computer program instructions which when executed by a computing system cause said system to perform a method, the method comprising:

determining a threshold gamut;

comparing a real gamut of the system with the threshold gamut; and color correcting input color based on the comparison, wherein color correcting includes adjusting the input color in the system having a wide gamut display, wherein data from at least one non-color managed application is drawn to a windows backing store with no color matching operation and a real gamut profile of the wide gamut display is replaced with a virtual gamut profile for color correction of the data, wherein data from an application that is color managed is color matched to the virtual gamut profile and then rematched to the real gamut profile of the display, wherein the virtual gamut profile is different than the real gamut profile of the display.

9. The medium as in claim 8 wherein the color correcting of the input color based on the comparison occurs when the real gamut exceeds the threshold gamut, wherein this comparison comprises comparing a size of the real gamut with a size of the threshold gamut in a chromaticity diagram.

10. The medium as in claim 9 wherein color correcting further comprising:

determining a limit gamut; and determining a virtual gamut that has a size that is greater than the size of the threshold gamut and less than the size of the limit gamut.

11. The medium as in claim 10 wherein the determining of the virtual gamut comprises:

determining the virtual gamut based on the real gamut, the threshold gamut, and the limit gamut in a chromaticity diagram.

12. The medium as in claim 11 wherein the determining the virtual gamut comprises:

determining a size of the virtual gamut from a size of the real gamut, a size of the threshold gamut, and a size of the limit gamut.

13. The medium as in claim 8 wherein determining the threshold gamut is based on a standard RGB color space (sRGB).

14. The medium as in claim 8 wherein the system includes the at least one non-color managed application and at least one color managed application, wherein data from the at least one color managed application is color matched from a source profile to a destination profile of the windows backing store.

15. A system, comprising:

memory to store color data for at least one non-color managed application and store color data for at least one color managed application;

a display device coupled to the memory, the display device to display the color data; and one or more processing units coupled to the display device;

one or more graphics processing units coupled to the display device, the one or more graphics processing units are configured to execute instructions to determine a threshold gamut value, to determine whether a real gamut value exceeds the threshold gamut value, and to color correct input color when the real gamut value exceeds the threshold gamut value, wherein data from the at least one non-color managed application is drawn to a windows backing store with no color matching operation and a real gamut profile of the display device is replaced with a virtual gamut profile for color correction of the data, wherein data from the at least one color managed application is color matched to the virtual gamut profile and then rematched to the real gamut profile of the display device, wherein the virtual gamut profile is different than the real gamut profile of the display device.

16. The system as in claim 15 wherein the determining of whether the real gamut value exceeds the threshold gamut value comprises comparing a size of a real gamut with a size of the threshold gamut in a chromaticity diagram.

17. The system as in claim 16 wherein color correcting further comprising:

determining a limit gamut based on a National Television System Committee (NTSC) color space or an Adobe RGB color space; and determining a virtual gamut that has a size that is greater than the size of the threshold gamut and less than the size of the limit gamut.

18. The system as in claim 17 wherein the one or more processing units are configured to execute instructions to store color data from the at least one non-color managed application to the memory with no color matching operation and to color match color data from the at least one color managed application from a source profile to a destination profile located in the memory.

19. The system as in claim 17 wherein the one or more graphics processing units are configured to execute instructions to replace the real gamut with the virtual gamut of the system and to perform color matching between the virtual gamut located in a windows backing store and a display gamut located in an assembly buffer.

20. A system for color correction, the system comprising:

means for determining a threshold gamut value;

means for determining whether a real gamut value of a display of the system exceeds the threshold gamut value; and means for color correcting input color if the real gamut value exceeds the threshold gamut value, wherein the system includes an application that is not color managed, wherein data from the application that is not color managed is drawn to a windows backing store with no color matching operation and a real gamut profile of the display is replaced with a virtual gamut profile for color correction of the data, wherein data from an application that is color managed is color matched to the virtual gamut profile and then rematched to the real gamut profile of the display, wherein the virtual gamut profile is different than the real gamut profile of the display.

21. The system as in claim 20 wherein the means for determining whether the real gamut value exceeds the threshold gamut value comprises comparing a size of a real gamut with a size of the threshold gamut in a chromaticity diagram.

22. The system as in claim 21 wherein the means for color correcting further comprising:

means for determining a limit gamut; and means for determining a virtual gamut that has a size that is greater than the size of the threshold gamut and less than the size of the limit gamut.

23. The system as in claim 21 wherein data from the application that is not color managed is drawn to a windows backing store with no color matching operation and data from the application that is color managed is color matched from a source profile to a destination profile of the windows backing store.

* * * * *